US005125859A

United States Patent [19]

Spurgeon

[11] Patent Number: 5,125,859

[45] Date of Patent: Jun. 30, 1992

[54] ADJUSTABLE RELEASE FOR SAILBOARD FOOTSTRAPS

[76] Inventor: Edward V. Spurgeon, 35 Raiders La., Darien, Conn. 06820

[21] Appl. No.: 665,424

[22] Filed: Mar. 6, 1991

[51] Int. Cl.[5] ..... B63H 9/04

[52] U.S. Cl. ..... 441/75; 114/39.2; 441/70; 24/602

[58] Field of Search ..... 114/39.2; 280/634; 24/602, 115 F; 441/74, 75, 70

[56] References Cited

U.S. PATENT DOCUMENTS

| | | | |
|---|---|---|---|
| 3,172,677 | 3/1965 | Marker et al. | 280/634 |
| 3,337,225 | 8/1967 | Smolka et al. | 280/634 |
| 3,704,633 | 12/1972 | Iverson | 24/602 |
| 3,982,747 | 9/1976 | Schweinsberg | 24/602 |
| 4,367,570 | 1/1983 | Barbal | 24/602 |
| 4,378,614 | 4/1983 | McKenney | 24/602 |
| 4,466,373 | 8/1984 | Prade et al. | 114/39.2 |
| 4,528,924 | 7/1985 | Marker et al. | 114/39.2 |
| 4,693,199 | 9/1987 | Omachen et al. | 114/39.2 |
| 4,846,744 | 7/1989 | Love | 114/39.2 |
| 4,960,063 | 10/1990 | Bontemps | 114/39.2 |

FOREIGN PATENT DOCUMENTS

| | | | |
|---|---|---|---|
| 3104412 | 8/1982 | Fed. Rep. of Germany | 114/39.2 |
| 83/00312 | 2/1983 | World Int. Prop. O. . | |

*Primary Examiner*—Sherman Basinger
*Assistant Examiner*—Thomas J. Brahan
*Attorney, Agent, or Firm*—Schweitzer, Cornman & Gross

[57] ABSTRACT

An adjustable release arrangement which can be added to existing footstraps on sailboards and the like. The existing footstrap nylon webbing is threaded through the metal tongue of the mechanism which engages a heavy spring latch in the mechanism box. The mechanism box is attached by nylon webbing to the buckle on the other end of the footstrap. The preferred method for adjusting the force required to pop open the footstrap is a thumbscrew which bears directly on the spring latch. The thumbscrew has markings corresponding to the release force and is prevented from inadvertent movement by means of a retaining arm. The entire mechanism is housed within the neoprene padding of the existing footstrap.

1 Claim, 1 Drawing Sheet

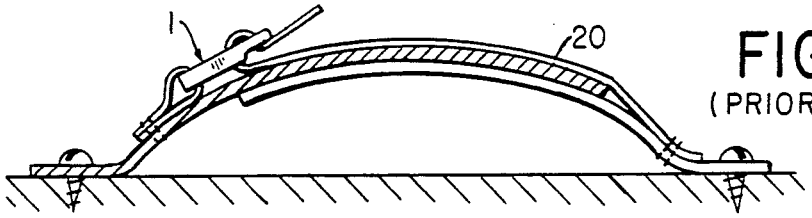
FIG. 1
(PRIOR ART)
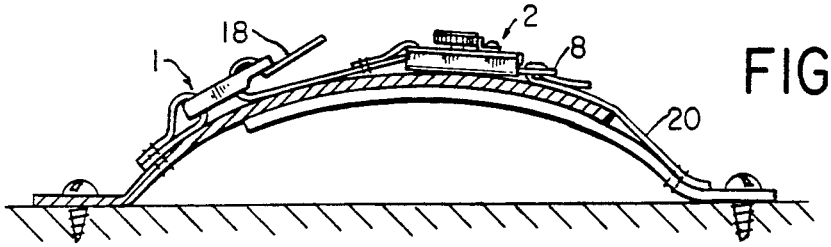
FIG. 2
FIG. 3
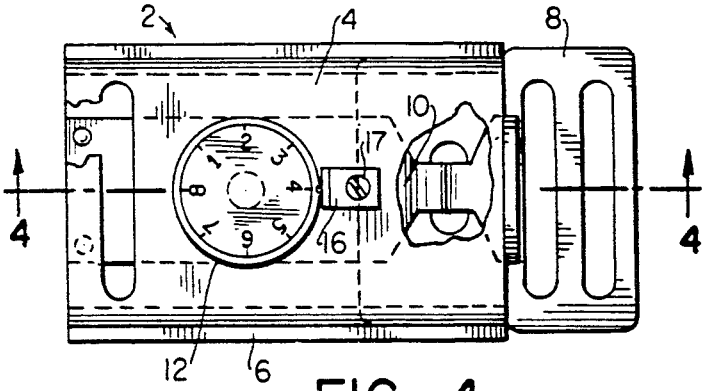
FIG. 7
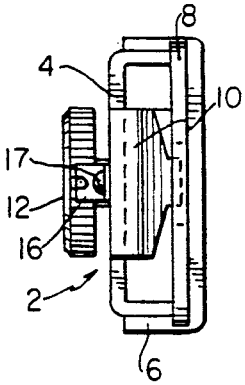
FIG. 4
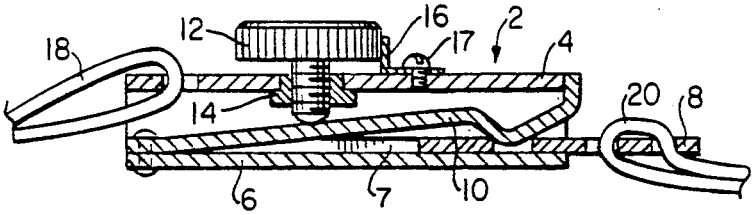
FIG. 5
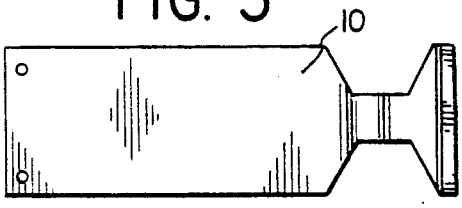
FIG. 6
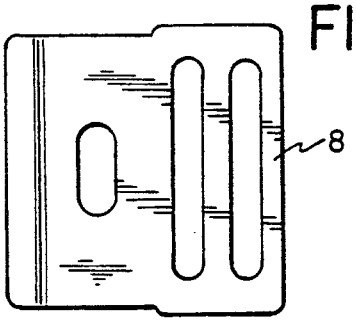
FIG. 5A
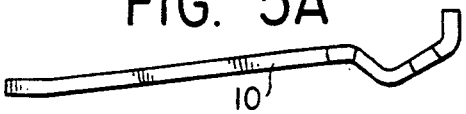
FIG. 6A
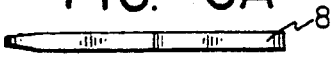

ADJUSTABLE RELEASE FOR SAILBOARD FOOTSTRAPS

BACKGROUND

1. Field of Invention

This invention relates to footstraps as employed with devices for riding upon such as sailboards, and the like, and more particularly, to an improved arrangement for releasing the foot to avoid injury.

2. Discussion of Prior Art

Sailboards such as those used in the sport of boardsailing or windsurfing are a fairly new innovation (approximately 1977) which have grown rapidly in popularity. As sailors gain proficiency in the sport they tend to sail faster (speeds can approach 40 knots) and become airborne off waves. Inasmuch as sailboards are steered with the sailor's feet, most sailboards are equipped with footstraps to insure solid foot contact and control of the sailboard.

Existing footstraps have no mechanism to quickly release the sailor's feet in the event that he or she falls off the sailboard. Consequently, injuries occur to feet, ankles, knees and legs.

The current and most frequently used method for avoiding injury is for the sailor to adjust the size of the footstraps small enough so that only this toes are engaged in the footstraps. This facilitates quick removal of the foot in the event of a mishap. But in practice, most sailors insert their feet much farther into the footstrap either because the straps are adjusted too large, they stretch, or the sailor likes the secure feeling of having more of his foot under the strap.

Various approaches to providing a release mechanism for footstraps appear in prior art. One approach is to form the footstrap in two parts which are joined by Velcro (Registered Trademark) fastener strips. The force necessary to release the strap is adjusted by cutting off some of the Velcro fastener mating strips so that the straps will tear apart under the predetermined force. The disadvantage of this approach is that once the footstraps are modified in this manner they cease to be adjustable to different footsizes or even to the same sailor who may want to sail with booties in cold weather and bare feet in warm weather.

U.S. Pat. No. 4,693,199 describes a release means for sailboard footstraps which can be set to release at a predetermined force. This patent utilizes two mating parts. The female part clamps onto the metal bosses on the male part. The clamping force is controlled by assembling one or more thin packing pieces to vary the opening on the female part. Changing these packing pieces requires disassembly of the mechanism including removal of two nut and bolt assemblies. This is disadvantage because the release mechanism needs to be easily changed to release at a force which relates to a sailor's weight and sailing style. Sailboards are often used by more than one sailor on a given day, therefore it is important that footstrap release forces by easy to change on the beach and on the water without tools.

Additionally U.S. Pat. No. 4,693,199 provides no visual indication to tell a sailor what release force has been set. Another disadvantage is that the mechanism can't be added to the existing footstraps on a sailboard. It requires the complete and costly replacement of the existing footstraps.

U.S. Pat. No. 4,960,063 describes mounting a release mechanism on the sailboard much like a ski binding is mounted on a ski. This has the disadvantage of becoming a toe-stubbing obstacle to the barefoot sailor, and it prevents mounting two footstraps closely one in front of the other. Also like U.S. Pat. No, 4,693,199 it cannot be added to existing footstraps and requires costly replacements.

Thus it can be seen that there is no easily adjustable releasing arrangement for sailboard footstraps and the like which is at the same time streamlined, light, simple, adjustable on the water, providing a visual indication of release force, and is able to be added on to existing footstraps.

OBJECTS AND ADVANTAGES

It is the object of this invention to provide an adjustable releasing arrangement for sailboard footstraps and the like which is (a) easy to set to meet the release requirements of individual sailors.

(b) easy to add to existing footstraps such as those of Windsurfing Hawaii (U.S. Pat. No. 4,846,744 the disclosure of which is incorporated by reference.)

(c) internal to the footstrap and not directly exposed to sand, or injurious to the feet (d) simple and low cost in construction (e) able to be visually checked for release force

DRAWINGS FIGURES

FIG. 1 is a simplified side view drawing showing a current sailboard footstrap such as Windsurfing Hawaii Feetbelts (Registered Trademark) U.S. Pat. No. 4,846,744. The protective covering is not shown.

FIG. 2 is a simplified side view drawing showing the installation of the adjustable releasing mechanism of the invention. The protective covering is not shown.

FIG. 3 is a plan view of the mechanism of FIG. 2.

FIG. 4 is a section view taken along the line 4—4 of the mechanism of FIG. 2 and attaching strap.

FIG. 5 is a top view of the spring latch of the mechanism of FIG. 2.

FIG. 5A is a side view of the spring latch of the mechanism of FIG. 2.

FIG. 6 is a top view of the tongue of the mechanism of FIG. 2.

FIG. 6A is a side view of the tongue of the mechanism of FIG. 2.

FIG. 7 is an end elevation of the mechanism of FIG. 2.

DESCRIPTION—FIGS. 1 TO 6

A typically embodiment of the adjustable releasing arrangement present invention is shown in FIG. 2, It has been added to the internal strap of an existing footstrap shown in FIG. 1. The straps and mechanism shown in FIG. 1 and 2 are normally enclosed in a neoprene sleeve (not shown) which protects the foot.

The mechanism assembly shown in FIG. 3 and FIG. 4 consists of top housing plate 4 and bottom housing plate 6. These housing plates are welded together and provide a longitudinal groove 7 between the bottom edge of the top housing plate 4 and the floor of the bottom housing plate 6. Groove 7 assures foolproof insertion of the tongue 8 and provides a rigid guide to align urge 8 with a spring latch 10. The approximate size of the box thus formed is that of a thin box of matches 1"×2"×5/16". The preferred material for housing plates 4 and 6, tongue 8, and spring latch 10 is corrosion resistant stainless steel. Alternatively, the housing plates 4 and 6 could be made of extruded aluminum or plastic.

Spring latch 10 is fastened inside the mechanism housing with rivets 13. In the preferred embodiment spring latch 10 is necked down from about ½" wide to 3/16" in order that the friction release point be centralized and controllable. Tongue 8 has a 1/16" shoulder to prevent inserting it too far into the mechanism assembly 2. An alternative to providing shoulders would be to weld a stop to the floor of bottom housing plate 4.

The preferred way of tensioning spring latch 10 is by a thumbscrew 12 which is held in place by a threaded insert 14. Thumbscrew 12 has tension indication markings on its top surface. Thumbscrew 12 is prevented from inadvertent turning and slippage by retaining arm 16. Retaining arm 16 is made of spring steel; and has a detent which engages the vertical serrations on the edge of thumbscrew 12. Retaining arm 16 is fastened to top housing plate 4 with screw 17.

The preferred way of attaching the mechanism to the existing footstrap nylon webbing is shown in FIG. 2. The free end of the existing footstrap webbing 20 is inserted through the two slots in the tongue 8.

A second piece of nylon webbing 18 is attached to the slot in the mechanism 2 and is threaded into the buckle 1 at the other end of the footstrap and severs to adjust the size of the footstrap.

OPERATION—FIGS. 1 TO 4

To install the mechanism 2 on an existing footstrap (FIG. 1–2) the user removes the existing nylon strap 20 from existing buckle 1 and inserts it into the slots on tongue 8. The nylon strap 18 attached to the mechanism is threaded through the existing buckle 1. An alternative installation is to completely remove the existing buckle and attach strap 18 directly to the footstrap mounting screw.

The foot is now inserted under the footstrap which is adjusted to size using existing buckle 1 or tongue 8.

The contour of spring latch 10 engages the slot in tongue 8 until the force exerted by the foot exceeds the spring tension. When this happens tongue 8 disengages and the footstrap pops open.

The user adjusts the release force by turning thumbscrew 12 to a point matching his weight and sailing style. He can note this setting by referring to the markings on thumbscrew 12.

SUMMARY, RAMIFICATION, AND SCOPE

Accordingly the reader will see that the adjustable releasing mechanism of this invention is easily installed on existing footstraps, is simple and economical, can be totally enclosed within the footstrap padding, and is readily adjustable to the individual sailor's weight and style of sailing. It should be valuable in reducing injuries from sailboard footstraps and the like.

Although the description above contains many specifications, these should not be construed as limiting the scope of the invention but merely providing illustrations of some of the currently preferred embodiments of this invention. For example, the spring can have other shapes such as helical, and the engagement surfaces can be of different configurations.

Thus the scope of the invention should be determined by the appended claims and their legal equivalent, rather than by the examples given.

I claim:

1. An adjustable release mechanism for a footstrap system which comprises, (a) a latch tongue element, (b) a latch housing having an opening at one end for the reception of said latch tongue element, (c) said latch housing comprising first and second housing members of generally channel-shaped cross sectional configuration, each having a central wall and spaced-apart flange walls extending integrally from the edges of the central walls, (d) the distance between the outside surfaces of the flange walls of one of said housing members being approximately equal to the distance between the inside surfaces of the flange walls of the other of said housing members, (e) said housing members being reversely oriented with respect to each other and said one housing member being received within the other and rigidly secured thereto to form an open ended chamber, (f) said housing members being so arranged that the flange walls of said one housing member are spaced a predetermined distance from the central walls of said other housing member and define therewith inwardly facing guide channels at each side of said housing, (g) said latch tongue element having a width such that its opposite edges are received in and closely confined by said inwardly facing guide channels, (h) a latch element associated with said latch housing and arranged for latching engagement with said tongue element upon insertion of said tongue element into said opening, (i) adjustable means yieldably urging said latch element and said tongue element into said latching engagement, and (j) said adjustable means including a manually adjustable member for increasing and decreasing the force required to effect release of said tongue from said latch element.

* * * * *